US005711183A

United States Patent [19]

Mattsson

[11] Patent Number: 5,711,183

[45] Date of Patent: Jan. 27, 1998

[54] DEVICE IN A BENDING UNIT

[75] Inventor: Michael Mattsson, Mörrum, Sweden

[73] Assignee: AB Volvo, Gothenburg, Sweden

[21] Appl. No.: 714,138

[22] PCT Filed: Mar. 23, 1995

[86] PCT No.: PCT/SE95/00309

§ 371 Date: Sep. 16, 1996

§ 102(e) Date: Sep. 16, 1996

[87] PCT Pub. No.: WO95/25608

PCT Pub. Date: Sep. 28, 1995

[30] Foreign Application Priority Data

Mar. 23, 1994 [SE] Sweden ..... 9400974

[51] Int. Cl.[6] ..... B21J 9/18; B21D 39/02

[52] U.S. Cl. ..... 72/451; 72/450; 100/282

[58] Field of Search ..... 72/450, 451; 100/271, 100/280, 281, 282; 29/243.58

[56] References Cited

U.S. PATENT DOCUMENTS

| | | | |
|---|---|---|---|
| 2,726,702 | 12/1955 | Laxo | 72/315 |
| 2,847,051 | 8/1958 | Renard | 72/315 |
| 3,058,512 | 10/1962 | Chebuhar et al. | 72/312 |
| 4,356,716 | 11/1982 | Aschauer . | |
| 5,050,422 | 9/1991 | Dorsett | 72/450 |
| 5,315,855 | 5/1994 | Jackson . | |
| 5,457,981 | 10/1995 | Brown et al. | 72/451 |
| 5,495,742 | 3/1996 | Dorsett | 72/450 |

FOREIGN PATENT DOCUMENTS

| | | |
|---|---|---|
| 461194 | 3/1988 | Sweden . |
| 958672 | 5/1964 | United Kingdom . |
| 1075663 | 7/1967 | United Kingdom . |
| WO 89/09101 | 10/1989 | WIPO . |

*Primary Examiner*—David Jones
*Attorney, Agent, or Firm*—Young & Thompson

[57] ABSTRACT

An arrangement for a bending unit for bending in a projecting edge flange (4) against a surface of a workpiece (3). The bending unit comprises a stand (1), supporting a drive unit, and a supporting surface for the workpiece, as well as a link system (7, 8), which in turn supports a tool holder (6) for a bending tool (5), which is displaceable along a predetermined path of movement between a starting position and a final position. The drive unit comprises a motor (17), which is coupled to a crankshaft (15). A toggle joint (17, 19) in the form of two links is joined, firstly, to a crank pin (16) rotatable with the crankshaft (15), and, secondly, to a fixed pivot point (9) in the stand (1). A drive link (21) is articulated, on the one hand, to a link (19) in the toggle joint, and, on the other hand, to the tool holder (6). The toggle joint is also provided with elements (24, 25) for buckling ut from the extended alignment position in either direction, depending on the rotational direction of the crankshaft (15).

5 Claims, 5 Drawing Sheets

DEVICE IN A BENDING UNIT

FIELD OF THE INVENTION

The invention relates to an arrangement for a bending unit for bending in a projecting edge flange against a surface of a workpiece, said bending unit comprising a stand supporting the drive unit and a supporting surface for the workpiece, as well as a link system which, in turn, supports a tool holder for a bending tool in such a manner that the tool is displaceable along a predetermined path of movement between a starting position remote from the supporting surface and the workpiece, and a final position in which the edge flange has been bent in against the surface of the workpiece.

BACKGROUND OF THE INVENTION

Bending units of the above type are well known in a number of different designs, and they are often used to bend in a sheet metal edge flange around the edge of another piece of sheet metal to create a welt to join the two pieces together. Operations of this type are common in the auto industry, for example, for manufacturing doors, engine hoods and similar body parts. A common type of drive device for such a bending unit comprises a hydraulic cylinder, which is coupled between the stand and the link system for the tool, whereby extension or retraction of the piston rod of the hydraulic cylinder causes the link system to give the tool the desired movement and provides the required force so that the tool can carry out the desired bending operation. In addition to the drive device itself, a hydraulic unit is required which provides the necessary hydraulic pressure, as well as hydraulic lines and control equipment.

SUMMARY OF THE INVENTION

The purpose of the invention is to provide an arrangement for a bending unit of the type described by way of introduction, which achieves the required driving and is of simple and reliable construction requiring relatively little space. This is achieved according to the invention by an arrangement of the type described by way of introduction, which is characterized in that the drive unit comprises a motor fixed to the stand and coupled to a crankshaft mounted in the stand, that a toggle joint in the form of two articulated links is joined, firstly, to a crank pin mounted on the crankshaft, secondly, to a fixed pivot point in the stand, that a drive link is articulated, on the one hand, to one of said links in the toggle joint and, on the other hand, to the tool holder or a link in the link system supporting the tool holder, and that the toggle joint is provided with means for buckling the toggle joint, from a straight alignment, in one direction or the other, depending on the rotational direction of the crankshaft.

Advantageous embodiments of the arrangement according to the invention are revealed in the subclaims.

BRIEF DESCRIPTION OF THE DRAWINGS

The invention will be described in more detail below with reference to the accompanying drawings which show one embodiment of the invention and in which.

DETAILED DESCRIPTION OF THE INVENTION

Figure 1:
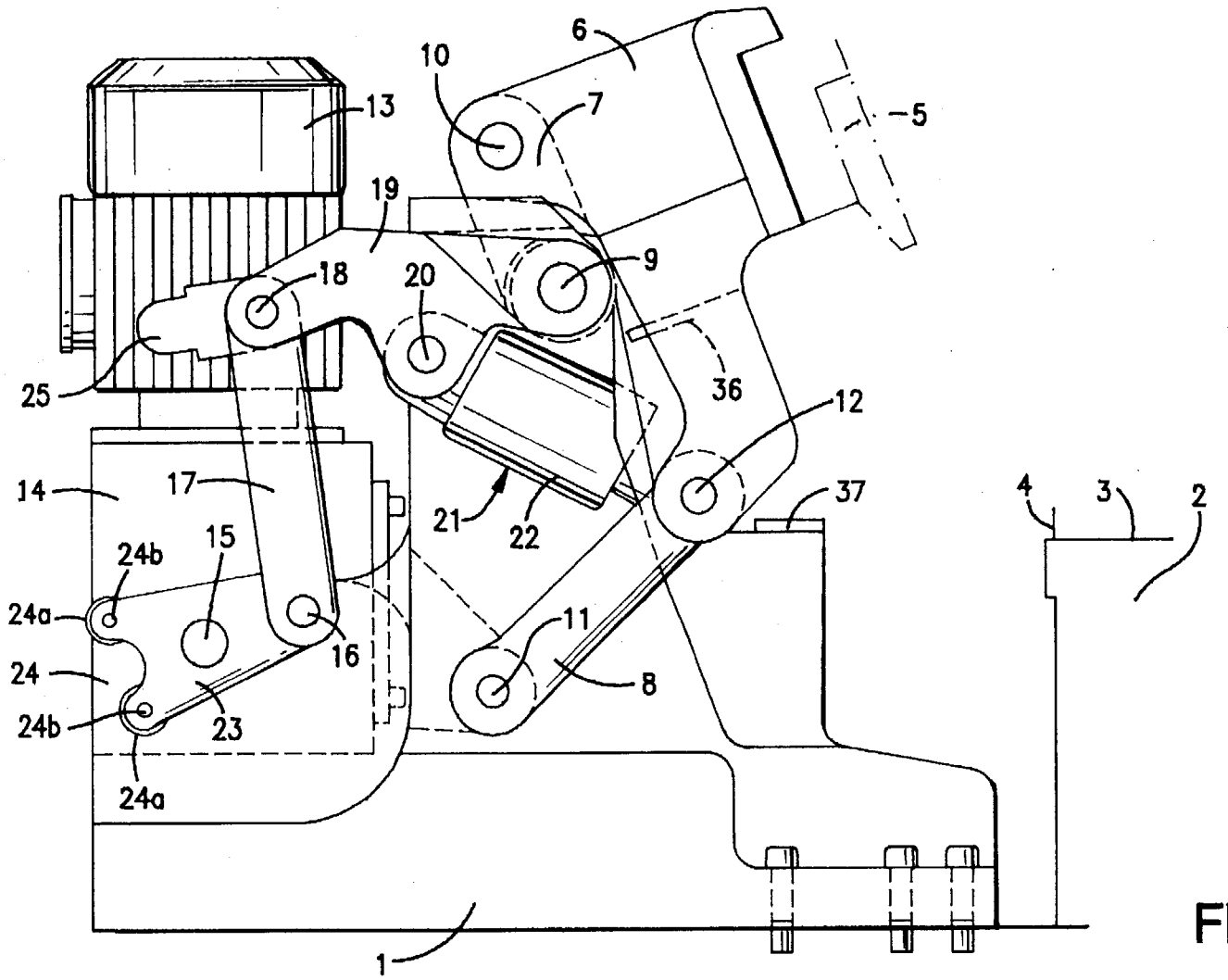
FIG. 1 is a side view of a device according to one embodiment of the invention, said device being shown in its starting position.

The bending unit shown in the drawings is constructed of a stand 1, which carries a supporting surface 2 for a workpiece 3 with an edge flange 4 to be bent in against the main portion of the workpiece 3 with the aid of a bending tool 5. The tool 5 is carried in a tool holder 6, which is in turn supported by a link system with two links 7 and 8. Link 7 is articulated at points 9 and 10 to the stand 1 and to the tool holder 6, respectively. The link 8 is articulated at pivot points 11 and 12, respectively, to the stand 1 and to the tool holder 6, respectively. The pivot points 9–12 are pins, about which the components can pivot. The links 7 and 8 form together with the stand 1 and the tool holder 6 a link system which makes it possible to move the tool holder 6 and the tool 5 relative to the stand 1 and the supporting surface 2, in such a manner that the tool 5 can be moved from the starting position shown in FIG. 1 to the final position shown in FIG. 4. As can be seen in the drawings, the links 7 and 8 are of different lengths, and thus the tool 5 will follow an arcuate path, but in the vicinity of the final position it will move essentially rectilinearly, since the links 7 and 8 are essentially parallel at that point.

To drive the tool 5 and the tool holder 6 along the predetermined path of movement, there is a drive unit comprising a motor 13, in this example an electric motor. Other types of motors are also conceivable, such as hydraulic or pneumatic motors. The motor 13 drives via a transmission 14 a crankshaft 15 mounted in the stand 1 and having a pin 16.

On the pin 16, one end of a link 17 is rotatably mounted and the other end of the link 17 is articulated at a pivot point 18, in the form of a pin, to the end of the second link 19. The other end of the second link 19 is pivotally mounted at the pivot point 9. The links 17 and 19 form together a toggle joint, the function of which will be described in more detail below.

Between the pivot points 9 and 18, the link 19 is provided with an additional pivot point 20 in the form of a pin. At the pivot point 20, one end of a drive link 21 is pivoted, while its other end is pivotally connected to the pivot point 12. The drive link 21 comprises a force limiting means 22, which, in the embodiment shown in the drawings, consists of a gas spring, i.e. a spring where the spring force is provided by a gas housed in a pressure cylinder and acting on the piston therein. A function of the force limiting means 22 will be described in more detail below.

As can be seen in the drawings, an arm 23 projects diametrically opposite from the pin 16 relative to the crankshaft 15. Said arm 23 has at its free end a notch 24. The notch 24 is intended to cooperate with a projection 25 on one end of the link 19 extending beyond the pivot point 18, as will be described in more detail below. In order to facilitate cooperation between the notch 24 and the projection 25, rollers **24*a* are arranged on either side of the notch 24. The rollers 24*a* are journalled on pins 24*b* mounted on the arm 23**.

The above described arrangement functions as follows: FIG. 1 shows the arrangement in its starting position with the tool holder 6 and the tool 5 located at their greatest distance from the workpiece 3 resting on the supporting surface 2. As can be seen in FIG. 1, the tool holder 6 and the tool 5 are pivoted far away from the supporting surface 2 and the workpiece 3, providing ample space to handle the workpiece 3 and replace it. This is made possible by virtue of the fact that the links 7 and 8 have different lengths, the link 7 being appreciably shorter than the link 8.

Figure 2:
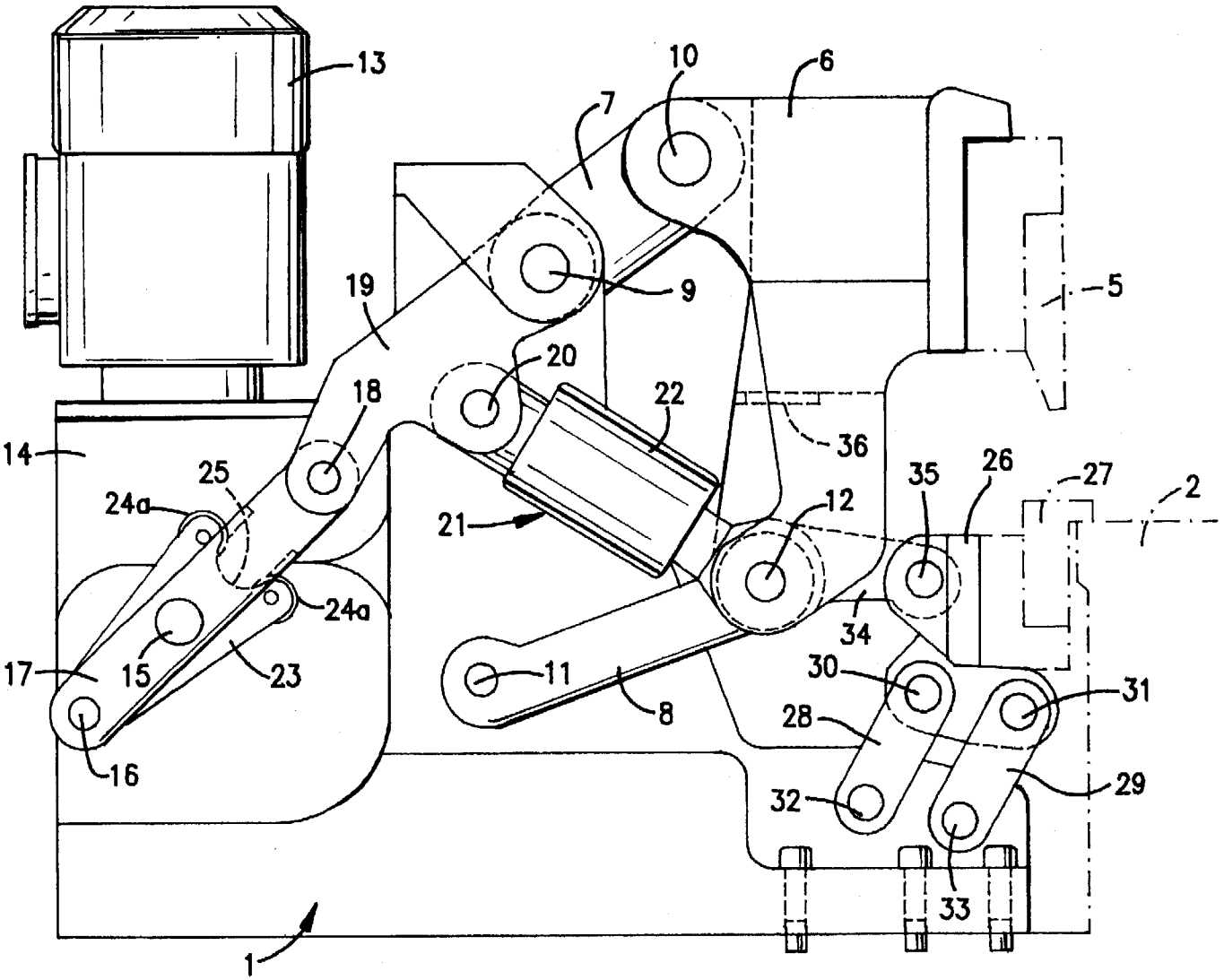
FIG. 2 is a side view corresponding to FIG. 1 but with the device shown in a transition position.

When the motor 13 is engaged, the crankshaft 15 rotates clockwise, as viewed in the drawing, and the toggle mechanism consisting of the links 17 and 19 will first become straightened out, whereby the tool holder 6 and the tool 5 will be moved by the drive link 21 downwards from the position shown in FIG. 1. At an intermediate position shown in FIG. 2, the pivot points 9, 18, 16, and the rotational axis of the crankshaft 15 will be in alignment with each other, which means that the toggle joint 17, 19 will be in straight alignment. The projection 25 on the link 19 will at this stage be inserted into the notch 24 in the arm 23. As can be seen in FIG. 2, the projection 25 rests against the rollers 24*a*, resulting in low friction during the interaction between the projection 25 and the notch 24. FIG. 2 also shows a prebending unit, comprising a tool holder 26 and a prebending tool 27. The tool holder 26 is supported by two links 28 and 29, mounted in pivot points 30 and 31, respectively, on the tool holder 26, and pivot points 32 and 33, respectively, on the stand 1. The links 28 and 29 form together with the stand 1 and the tool holder 26 a parallellogram linkage system, which makes it possible for the tool holder 26 and the tool 27 to move towards and away from the supporting surface 2 and the workpiece 3. This movement is controlled by a drive link 34, which is connected to the pivot point 12 between the link 8 and the drive link 21 and to a pivot point 35 on the tool holder 26. In the position shown in FIG. 2, the tool 27 is a short distance from the workpiece 3 on the supporting surface 2.

Figure 3:
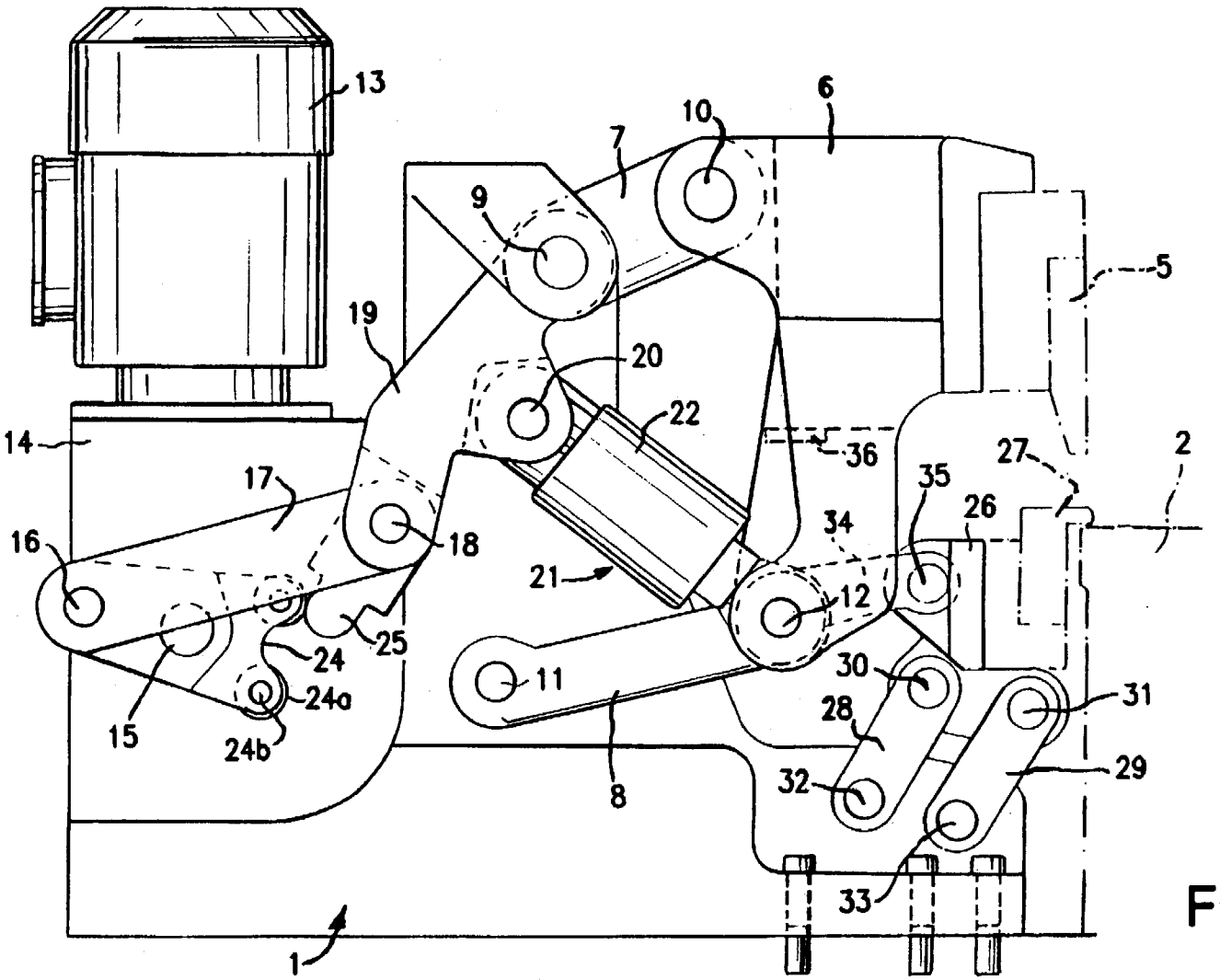
FIG. 3 is a side view corresponding to FIG. 1 but with the device shown in a prewelting position.

As the crankshaft 15 continues to rotate clockwise, the notch 24 will move the projection 25 obliquely downwards to the right, as seen in the drawings. This is shown in FIG. 3 and this will mean that the toggle joint 17, 19 will be buckled in one specific direction, so that the drive link 21 can continue to move the tool holder 6 and the tool 5 towards the workpiece 3 on the supporting surface 2. At the same time, the link 8 and the pivot point 12 are displaced downwards and reach the position shown in FIG. 3, where the pivot points 11, 12 and 35 are essentially in alignment with each other. This means that the toggle joint formed by the links 8 and 34, will be in its fully extended position. At this point, the prebending tool 27, as shown in FIG. 3, will be in its final position in which the prebending operation has been completed.

When the tool 5 and the tool holder 6 approach the final position shown in FIG. 2, the edge flange 4 is bent in against the workpiece 3 in the desired manner. At the same time, the toggle joint 8, 34 is buckled out so that the tool holder 26 and the prebending tool 27 are moved away from the workpiece 3 and the supporting-surface 2.

Figure 4:
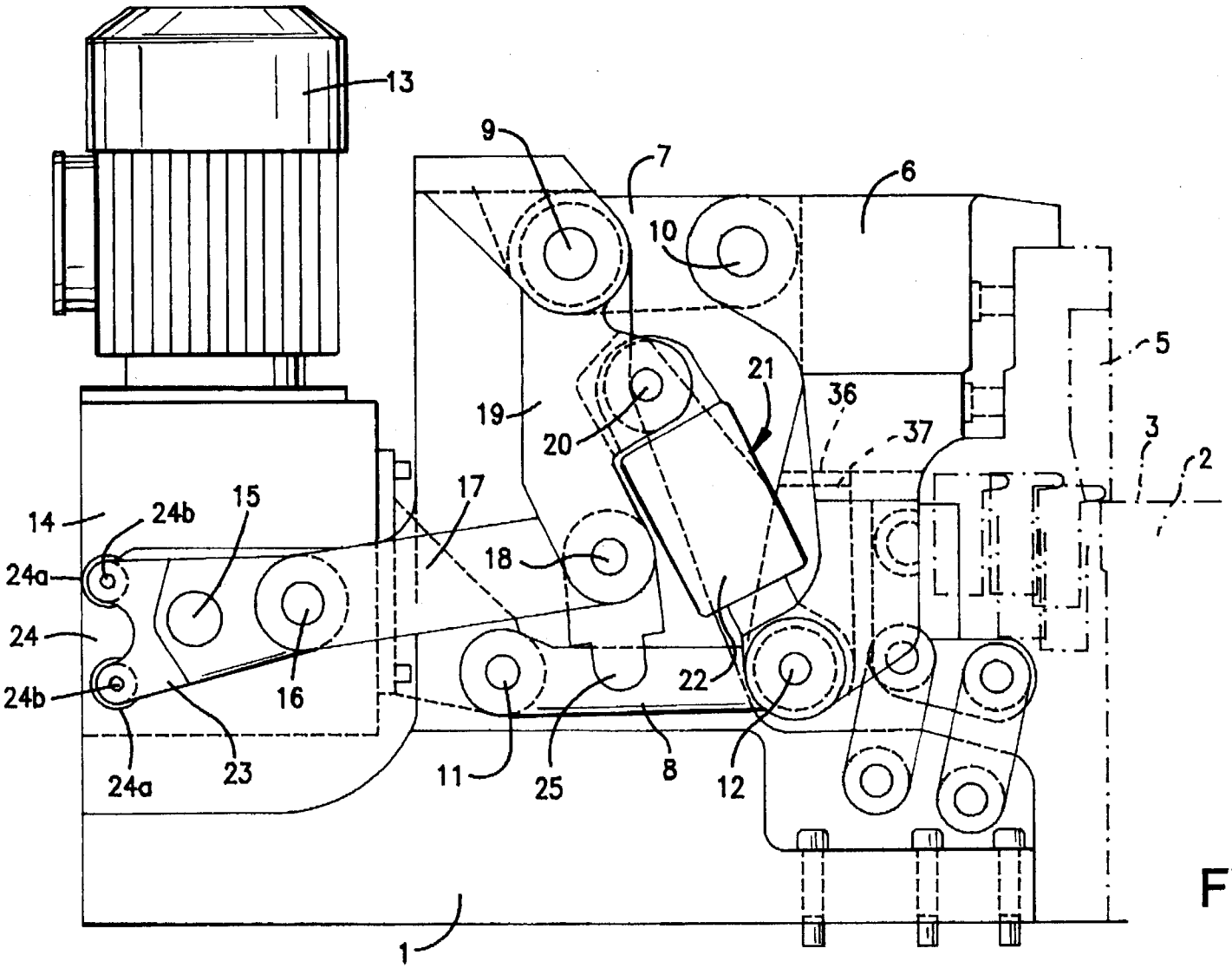
FIG. 4 is a side view corresponding to FIG. 1 but with the device shown in a final position after a completed bending operation.

In the final position shown in FIG. 4, the pivot points 9, 12 and 20 will be essentially in alignment with each other, thus creating here as well a toggle joint, thereby making it possible to exert a very large force in the final position.

To determine the force which the tool 5 exerts against the edge flange 4 and the workpiece 3, the force limiting means 22 is actuated, so that continued movement of the toggle mechanism 17, 19 will cause a compression of the force limiting means 22 and a corresponding shortening of the drive link 21.

In this manner there is always applied a predetermined force by the tool 5 during the bending operation. As an alternative, it is possible, with fixed stops 36 and 37, respectively, on the tool holder 6 and on the stand 1, to determine a fixed final position for the tool 5, and continued movement of the toggle joint 17, 19 will, thanks to the force limiting means 22, not cause any overloading of the components making up the arrangement.

For the return movement of the tool 5 and the tool holder 6, the motor 13, and thus the crankshaft 15, are driven in the opposite rotational direction; in this case the crankshaft 15 will rotate counter-clockwise. The toggle joint 17, 19 will move in the opposite direction and thus pull with it the drive link 21 and the tool holder 6 with the tool 5.

Figure 5:
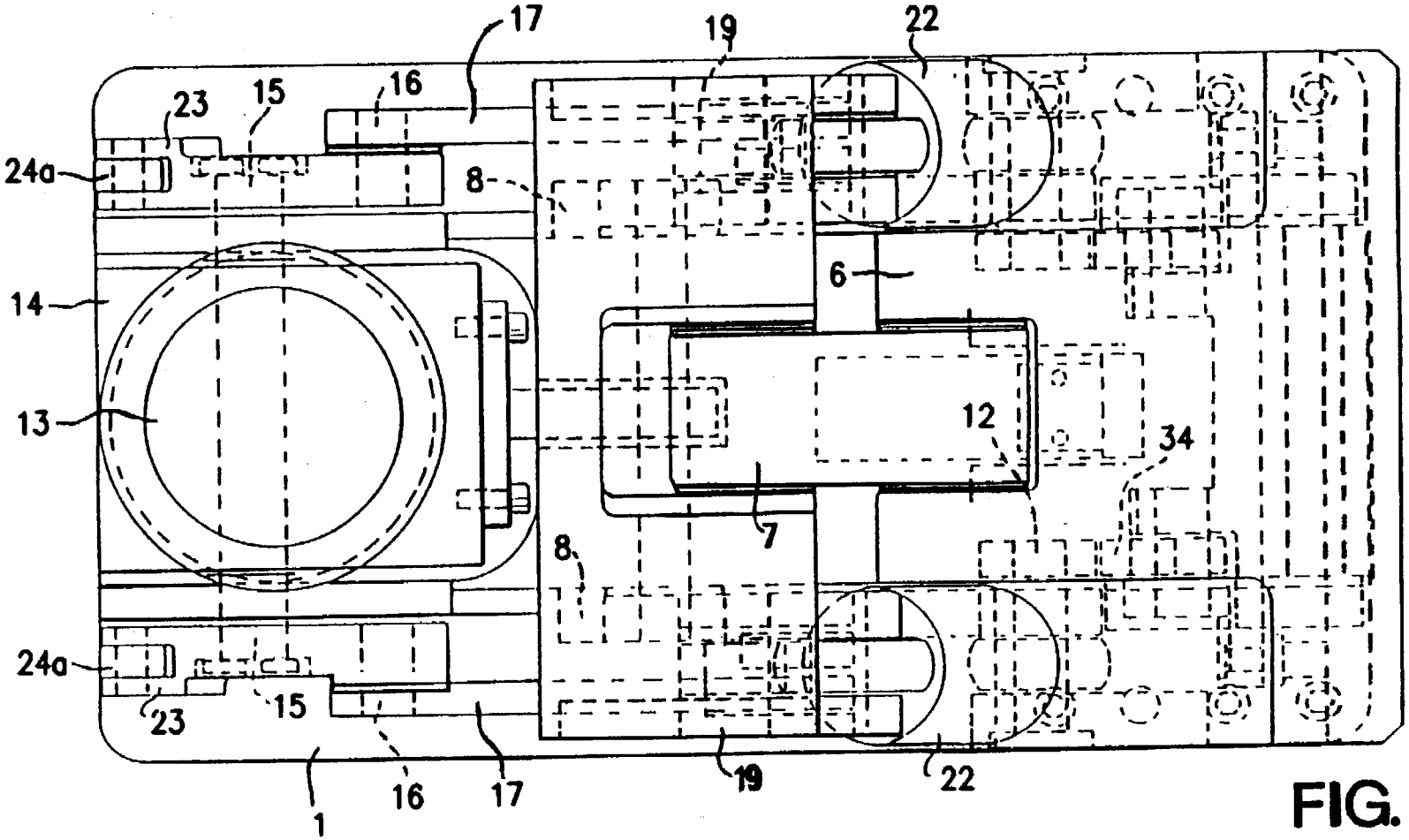
FIG. 5 shows from above a view of the device shown in FIGS. 1–4.

When the toggle joint 17, 19 reaches its extended position, the projection 25 will be inserted into the notch 24. Continued rotation of the crankshaft 15 counter-clockwise will cause the notch 24 to move the projection 25 obliquely upwards to the left as seen in the drawings, so that the toggle joint 17, 19 is buckled out in the opposite direction and the tool holder 6 with the tool 5 will, as the crankshaft 15 continues to rotate, be returned to the starting position shown in FIG. 1. FIG. 5 shows the device according to FIGS. 1–4 from above, thus revealing that the device is symmetrically designed with the motor 13 and the gearbox 14 arranged centrally. The crankshaft 15 extends in both directions from the gearbox 14, and the entire link system is duplicated, i.e. identical link systems are arranged on either side of the motor 13 and the gearbox 14, with the exception of the link 7 and the tool holder 6 with the tool 5, of which there is only one placed centrally. The entire mechanism is otherwise duplicated, thus avoiding uneven loading at the same time as a more stable system is achieved. Placing the motor 13 and the gearbox ! 4 in the center makes the entire arrangement relatively narrow as well, thus facilitating use of the arrangement in narrow spaces or use together with a plurality of arrangements arranged closely adjacent to each other.

The invention is of course not limited to the example shown above. Rather, changes can be made within the scope of the attached claims.

I claim:

1. In an arrangement for a bending unit for bending in a projecting edge flange against a surface of a workpiece, said bending unit comprising a stand supporting a drive unit and a supporting surface for the workpiece, a link system which supports a tool holder for a bending tool in such a manner that the tool is displaceable along a predetermined path of movement between a starting position remote from the supporting surface and the workpiece, and a final position in which the edge flange has been bent in against the surface of the workpiece, the improvement wherein:

the drive unit comprises a motor fixed to the stand and coupled to a crankshaft rotatably mounted in the stand;

a toggle joint in the form of two articulated links joined, firstly, to a crank pin mounted on the crankshaft, and secondly, to a fixed pivot point in the stand;

a drive link having two ends, a first end being articulated to one of said links in the toggle joint and a second end being articulated to one of the tool holder and a link in the link system supporting the tool holder; and said toggle joint being provided with means for buckling the toggle joint, from a straight alignment, in one direction or the other, depending on the rotational direction of the crankshaft.

2. Arrangement according to claim 1, wherein the means for buckling out the toggle joint, comprise a projection on the link of the toggle joint located remote from the crankshaft, said projection in the extended alignment position of the toggle joint being disposed in a notch in an arm extending away from the crankshaft, said notch being located diametrically opposite the crank pin.

3. Arrangement according to claim 1, wherein the drive link is provided with a force limiting means, which, if a predetermined load is exceeded, can provide resilient change in the length of the drive link.

4. Arrangement according to claim 3, wherein the force limiting means consists of a spring.

5. Arrangement according to claim 2, wherein the drive link is provided with a force limiting means, which, if a predetermined load is exceeded, can provide resilient change in the length of the drive link.

* * * * *